United States Patent [19]

Miller et al.

[11] Patent Number: 4,961,769

[45] Date of Patent: Oct. 9, 1990

[54] MAT PATTERN CONTROL SYSTEM AND METHOD

[75] Inventors: William R. Miller, Bremen; Jerome P. Klink, Granville, both of Ohio

[73] Assignee: Superior Glass Fibers, Inc., Bremen, Ohio

[21] Appl. No.: 474,352

[22] Filed: Feb. 2, 1990

Related U.S. Application Data

[63] Continuation-in-part of Ser. No. 309,301, Feb. 13, 1989, Pat. No. 4,921,517.

[51] Int. Cl.[5] ..... C03B 37/02

[52] U.S. Cl. ..... 65/4.4; 65/9; 156/167; 226/5; 226/6

[58] Field of Search ..... 65/4.4, 9; 156/167; 226/5, 6

[56] References Cited

U.S. PATENT DOCUMENTS

| | | | |
|---|---|---|---|
| 2,875,503 | 3/1959 | Frickert | 156/167 X |
| 3,511,625 | 4/1970 | Pitt | 65/4.4 X |
| 3,546,898 | 12/1970 | Langlois et al. | 65/9 X |
| 3,597,175 | 8/1971 | Pitt | 65/4.4 X |
| 3,599,848 | 8/1971 | Thumm et al. | 65/9 X |
| 3,746,230 | 7/1973 | Gelin | 65/9 X |
| 4,046,538 | 9/1977 | Thomas | 65/4.4 |
| 4,263,033 | 4/1981 | Michalek | 65/9 X |
| 4,266,960 | 5/1981 | Scott et al. | 65/4.4 |
| 4,496,384 | 1/1985 | Lin | 65/9 X |
| 4,601,741 | 7/1986 | Stotler | 65/4.4 |

*Primary Examiner*—Robert L. Lindsay
*Attorney, Agent, or Firm*—Frank H. Foster

[57] ABSTRACT

A method and means for superimposing a secondary, higher frequency, lower amplitude oscillation of the angle of the trajectory of a glass fiber relative to a forming surface upon a primary, lower frequency, higher amplitude oscillation of the release mechanism.

26 Claims, 5 Drawing Sheets

MAT PATTERN CONTROL SYSTEM AND METHOD

TECHNICAL FIELD

This application is a continuation-in-part of application Ser. No. 07/309,301, filed Feb. 13, 1989, now U.S. Pat. No. 4,921,517, issued May 1, 1990.

This invention relates to the field of glass fiber mat manufacturing.

BACKGROUND ART

Presently, glass fibers are formed into a mat material, somewhat like a fabric. This material has a variety of uses. For example, it may be later mixed with a synthetic resin to form a strong, durable fiberglass material or it may be used as a filter.

The general method presently being used to form glass fiber mat comprises projecting glass fibers from a cylindrical drum onto a laterally moving conveyer to form layers of fibers arranged in a generally random, horizontal fashion. These fibers and fiber layers are later bonded together to form a mat.

The industry which uses this mat in its products has begun to require a more homogeneous and uniform pattern of fibers in the mat than the randomly oriented fibers in the mat produced by the conventional methods. This is due to the fact that the products which are formed from the glass fiber mat and the processes by which they are formed have become more precise and thus tolerate fewer inconsistencies and flaws in the materials used.

The characteristics of conventionally manufactured mat are generally random and uncontrollable. One portion of the mat may have very high strength while another portion may have very low strength or even be devoid of mat. T h i s randomness and uncontrollability leads to mat which does not perform predictably in forming processes and which leads to faulty products.

Controlling the directionality of the strength of glass fiber mat is crucial. This is because the different manufacturing methods of today require many different strength characteristics. Where one process may require equal strength in all directions, another may require as much strength as possible in one direction with a considerably lesser requirement of strength in the opposite direction. For example, a ladder rail should have greater strength longitudinally than it has laterally, but some lateral strength is also necessary. Products like this are typically formed by a pultrusion process.

Pultrusion is a process in which glass fiber roving and glass fiber mat are pulled first through a resin bath, then into a forming die and then cured through a number of possible processes. This is similar to extrusion in its final product, but is used with fiberglass instead of metal. The roving provides the principal longitudinal strength reinforcement but provides essentially no lateral strength reinforcement. Consequently, the glass fiber mat is used to supply the necessary lateral strength. Thus, since the purpose of the mat is to provide the lateral reinforcement, pultrusion requires a mat which will provide a high degree of strength in the lateral direction of the finished product. Pultrusion also requires that a sufficient quantity of resin be drawn from the bath into the die with the glass fiber mat.

Match metal die molding, where two interlocking molds press and cure a mat and resin, requires as well that the glass fiber mat retain a certain amount of resin but with the mat having strength characteristics equal in all directions, that is, omni-directional strength.

Other processes in which resin is injected into an assembled mold, through the glass fiber mat, require similar mat characteristics to match metal die molding.

All of the previously mentioned processes require that the mat be uniform in its arrangement of the fibers throughout the mat for predictable performance characteristics. The methods which are presently used to form glass fiber mats do not provide sufficient control over the dimensions or orientation of the layers of glass fibers. This control is required to ensure the uniformity of the glass fiber mat and therefore the predictability of the performance of the finished product formed from the mat.

Another characteristic of the mat, which plays an important role in the highly precise processes, is the ability of the mat to pick up and transport within it a sufficient quantity of resin. This ability is a function of fiber surface area, mat density and the spacing between the fibers. These factors are important in determining the amount of resin carried into the forming dies, or held in the dies by the mat. It is therefore desirable to have control over them.

The highly precise processes and the precision they require create a need for a mat pattern control method which gives control over critical parameters of manufacture and which increase uniformity of the final product.

BRIEF DISCLOSURE OF INVENTION

This invention relates to a glass fiber mat manufacturing method comprising the passing of at least one glass fiber over at least one cylindrical drum. The glass fiber is subsequently released from the cylindrical drum and projected onto a forming surface such as a conveyer by a release mechanism. The release mechanism is operating at a primary oscillation of the angle of the trajectory of the glass fiber relative to the conveyer. The improvement is in the mat pattern control method and apparatus which comprises a secondary oscillation of the angle of the trajectory of the glass fiber relative to the conveyer. This secondary oscillation is superimposed upon the primary oscillation at a higher frequency and a lower amplitude than the primary oscillation.

In describing the preferred embodiment of the invention specific terminology will be resorted to for the sake of clarity. However, the invention is not limited to the terms so selected and each specific term includes all technical equivalents which operate in a similar manner to accomplish a similar purpose.

DETAILED DESCRIPTION

Figure 1:
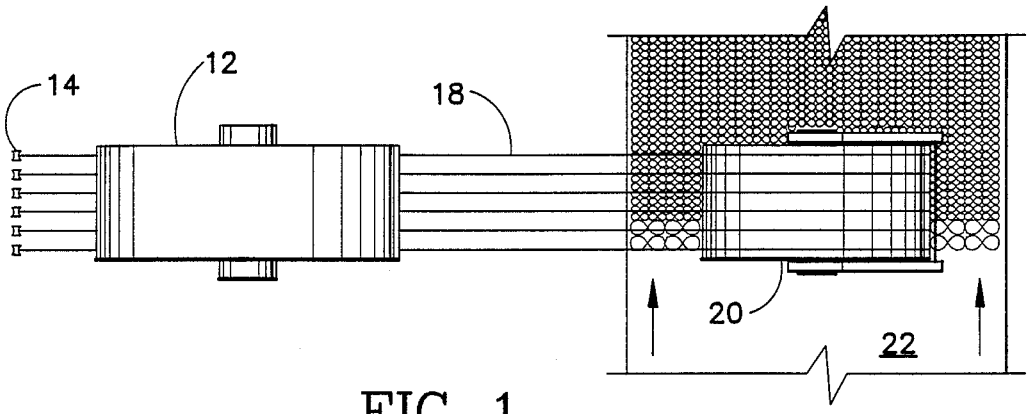
FIG. 1 is a view in perspective showing a top view of the preferred embodiment of the present invention.
Figure 2:
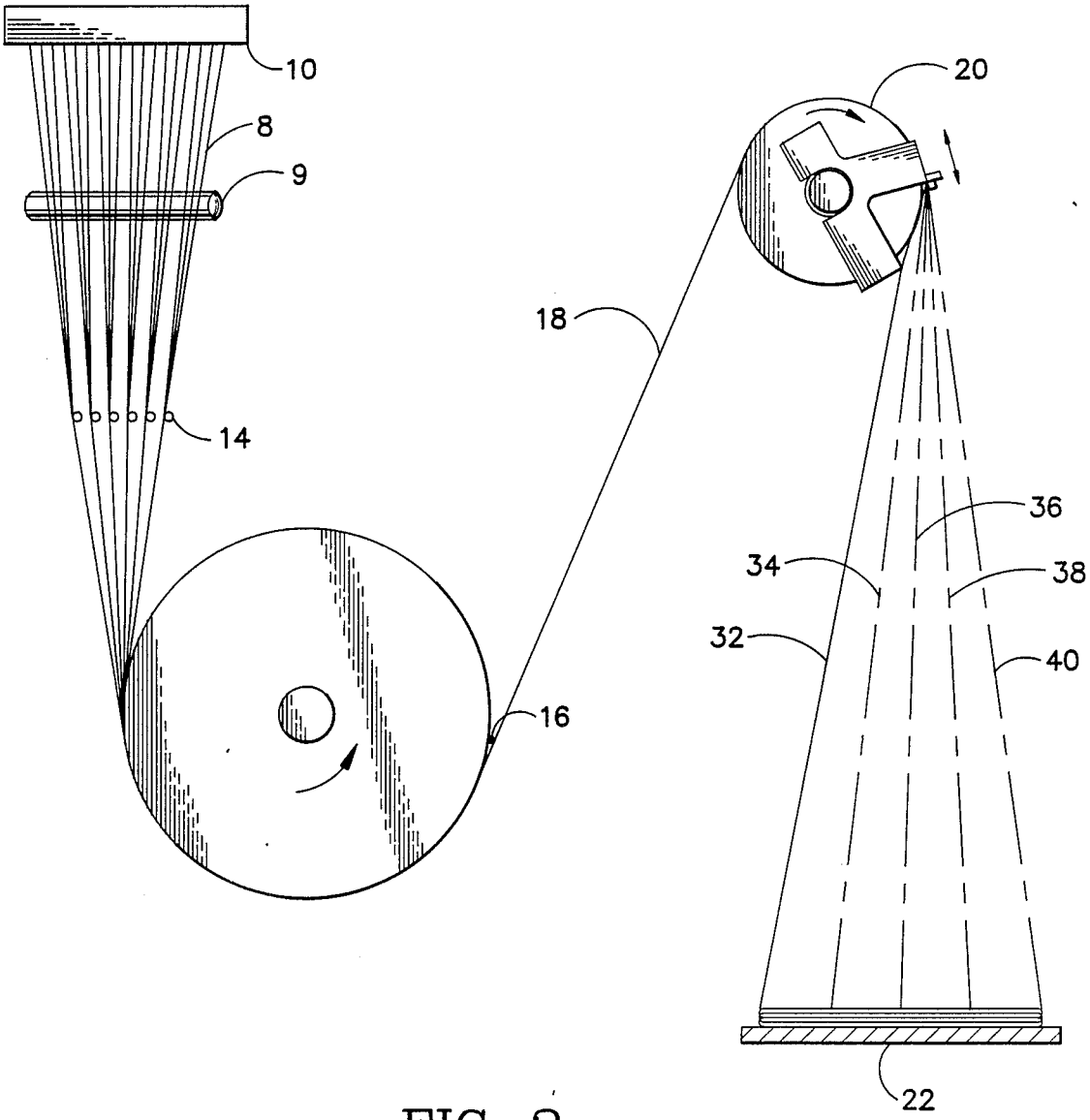
FIG. 2 is a view in perspective showing a side view of the preferred embodiment shown in FIG. 1.

Referring to FIGS. 1 and 2, a plurality of molten glass fibers are drawn by a pulling wheel 12 from a plurality of orificed projections 10 which are conventionally formed on the bottom of a glass melting furnace. The fibers are pulled across a conventional sizing applicator wheel to apply sizing and then through shoes or rotating sheaves 14 and gathered into strands in the conventional manner. For example, in the preferred embodiment 300 filaments are gathered into 10 multi-fiber strands, each composed of 30 filaments per strand. The filaments 8 and the sheaves 14 are oriented in a plane which is parallel to the axis of rotation of the pulling wheel 12, but are diagrammatically illustrated for clarity.

The fibers are carried along the lower periphery of the rotating pulling wheel 12 until they are stripped from the pulling wheel 12 by means of a wire 16 stretched tightly across the outer circular periphery of the pulling wheel 12. This causes the fibers 18 to be projected along a trajectory, substantially tangentially of the pulling wheel 12 and impinge upon a second pulling wheel 20.

The glass strands are carried around the second pulling wheel 20 and in accordance with the present invention are stripped from the pulling wheel 20 in a manner which causes them to be projected onto a conventional, foraminous, linked chain conveyer 22, positioned below the pulling wheel 20. They are projected in a manner which causes the strands to repetitively loop back and forth across the width of the conveyer 22 and build up a layer of stacked, intertwined strands to form the glass fiber mat. As the strands are built up, the conveyer 22 advances transversely to the lateral path of impingement of the fibers on the conveyer support surface 22. Binder may then be added. This system is described in more detail in the above-identified patent.

A support frame 24 provides a stripping body support means which movably supports a wire 26 or other stripping body. This stripping body 26 is supported tightly across the peripheral surface of the pulling wheel 20, transverse to the fiber travel direction on the peripheral surface 28 and preferably parallel to the axis of rotation of the pulling wheel 20. The stripping body support frame 24 is pivotable so that it can reciprocate the stripping wire 26 along an arcuate path adjacent to the peripheral surface 28 of the pulling wheel 20. The wire 26, or other stripping body with a suitably thin edge which can function equivalently, reciprocates within an arc from which tangents to the wheel 20 intersect the support surface of the conveyer 22. A drive means is linked to the stripping body support frame 24 for driving the stripping body wire 26 in its arcuate reciprocation.

Figure 3:
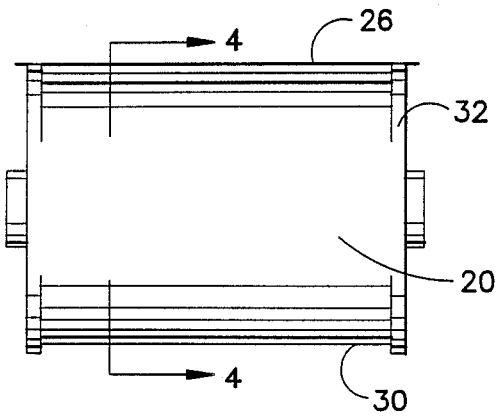
FIG. 3 is a view in perspective showing a pulling wheel with lobes and their surface position relative to a release mechanism.

A channel whose depth is graduated about the circumference of the pulling wheel 20 is formed on the center portion of the peripheral surface of the pulling wheel 20 forming a lobe 30 in the surface of the pulling wheel 20, shown in FIG. 3. Because a lobe 30 is formed in the pulling wheel 20, the channel surface's depth relative to the remaining outer edges 32 oscillates during rotation of the pulling wheel 20.

The lobe 30 may be formed in a conventional method as follows. A cylindrical drum may be formed by turning on a lathe. This cylindrical drum is then remounted on the lathe to give it a new center of rotation. This new, second center of rotation is offset from the original center of rotation by a very small amount, on the order of ten thousandths of an inch. The cylindrical drum is machined around this second center of rotation, forming a wide channel in the center portion of the peripheral surface of the cylindrical drum. This creates a single cam eccentric with the remaining outer edges 32 having a center of rotation at the original, first center of rotation. These outer edges 32 are significantly narrower than the channel. The lobe surface's center of rotation is the second center of rotation.

The cylindrical drum is then removed from the lathe and is remounted at a third center of rotation. This third center is in alignment with the other two centers, is on the opposite side of the first center and at an equal distance as the second center. The cylindrical drum is then machined to form another channel, of equal width and equal maximum depth as the first channel, in the peripheral surface of the cylindrical drum. In the preferred embodiment, therefore, there are two opposing lobe surfaces which are equal in dimension. There may, however, be more or less than two lobes.

Figure 4:
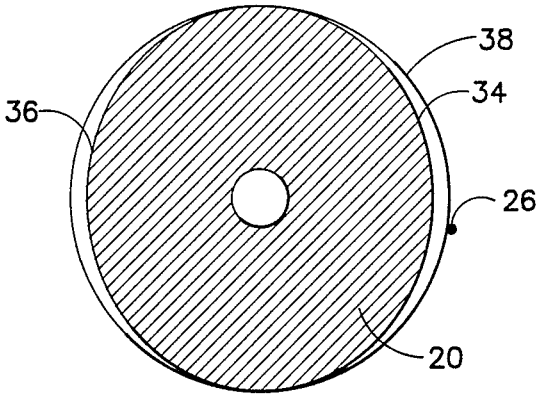
FIG. 4 is view looking down the line 4—4 showing the pulling wheel of FIG. 3 in cross-section.

Referring to FIG. 4, the illustration provides a cross-section of the pulling wheel 20 as seen looking down the axis of rotation of the pulling wheel 20 shown in FIG. 3. The illustration shows two lobes 34 and 36 formed on opposite sides of the pulling wheel 20, having equal maximum distances between the edges 38 and the lobe surface. The stripping body 26 rests upon the edges 38 and maintains its position relative to the original center of rotation throughout operation of the preferred embodiment.

During operation, the pulling wheel 20 is rotated about its first center of rotation resulting in an oscillation of the distance between the stripping body 26 and the lobe surface. An oscillation of the lobe surface in and out from the edge's peripheral surface occurs twice for each revolution of the pulling wheel 20. This gives an oscillation of the distance between the stripping body 26 and the glass fibers which rest on the lobe surface.

Figure 5:
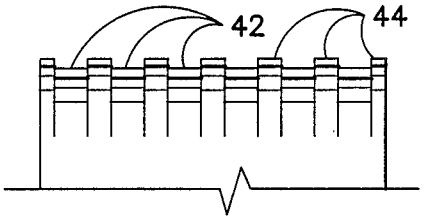
FIG. 5 is a view in perspective of an alternative embodiment of a pulling wheel.

It is possible to machine into a pulling wheel 40 a series of channels 42 between the edges 44, as shown in FIG. 5. These channels 42 should give the pulling wheel 40 different lobe dimensions where the glass fibers could pass either on top of the edges 44 or in the channels 42. This embodiment would allow the operator to merely move the pulling wheel 40 parallel to the axis of rotation a small amount and effectively change the maximum distances between the stripping body and the pulling wheel surface. This could be done while in operation or with very little time of halted operation.

The operation of the release mechanism in relation to the glass fibers on the pulling wheel 20 is as follows and as illustrated in FIGS. 1 and 2. A support frame 24 oscillates at a primary oscillation around an axis of rotation that is preferably coaxial with the axis of rotation of the pulling wheel 20. The support frame 24 oscillates, moving the stripping body 26 in an arcuate path in contact with the peripheral surface of the pulling wheel 20. This primary oscillation has a low frequency and a high amplitude. That is, it slowly oscillates back and forth along a long arcuate path around the pulling wheel 20.

As the support frame oscillates around the pulling wheel 20, the stripping body 26 causes the glass fibers, which are passing over the pulling wheel 20, to be released from the pulling wheel 20 and projected downward onto the conveyer 22. The primary oscillation of the stripping body 26 forms a lateral back and forth motion across the conveyer 22 of the point of impingement of the glass fibers, forming a mat.

While the primary oscillation causes the fibers' point of impingement to oscillate along the width of the conveyer 22, there is a secondary oscillation superimposed upon the primary oscillation. This secondary oscillation causes the glass fibers trajectories' angle, as they leave the stripping body 26, to oscillate relative to the conveyor 22. This oscillation of the trajectories occurs at a much higher frequency and a much lower amplitude than the primary oscillation of the glass fibers across the width of the conveyer.

This secondary oscillation occurs, in the preferred embodiment, in the following manner. As an observed portion of the glass fiber passes over the pulling wheel 20, it stays in contact with the pulling wheel 20 until the fiber portion approaches the stripping body 26. When the fiber portion reaches a certain distance from the stripping body 26, it is drawn away from the pulling wheel surface by the preceding portion of the same fiber, which has previously contacted the stripping body 26. The observed fiber portion continues from the pulling wheel surface to the stripping body 26 and then beyond, being projected toward the conveyer.

Figure 6:
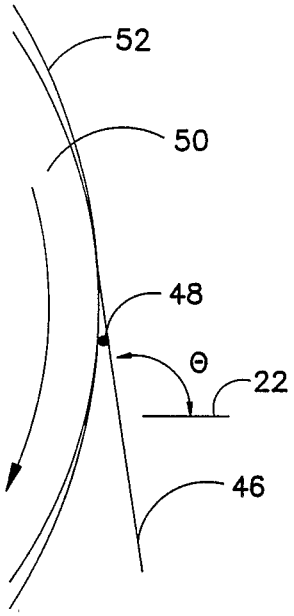
FIGS. 6, 7, and 8 are progressive views of the rotation of the pulling wheel of FIG. 4 in operation.

Referring to FIG. 6, it is illustrated that a glass fiber 46 is being projected from a stripping wire 48 at an angle of theta with respect to the conveyor 22. This angle theta occurs when the stripping wire 48 contacts the peripheral surface of a rotating pulling wheel 50 completely across the pulling wheel 50. That is, when the depth of the channel, where the stripping wire 58 contacts the edges 52 of the pulling wheel 50, is at its minimum.

Figure 7:
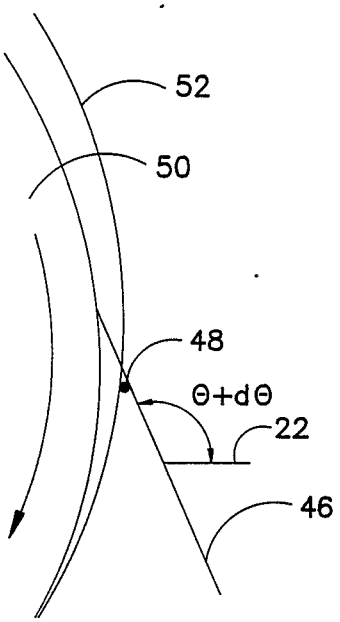

FIG. 7 shows a further progression of the pulling wheel 50 in its path of rotation. The peripheral surface of the channel on the pulling wheel 50 has begun to recede from the stripping body 48. This introduction of a distance between the stripping body 48 and the channel surface on which the glass fiber 46 rests produces a change in the angle of the glass fiber's 48 trajectory relative to the conveyer 22. The angle changes by a differential amount d theta. The resulting angle is then theta plus d theta. This change in angle is a result of the stripping wire 48 following the contour of the edges 52 of the pulling wheel 50, and the glass fiber 46 staying on the surface of the pulling wheel 50. The distance between the stripping wire 48 and the channel surface changes with no substantial difference in the point of release from either the stripping wire 48 or the channel surface.

Figure 9:
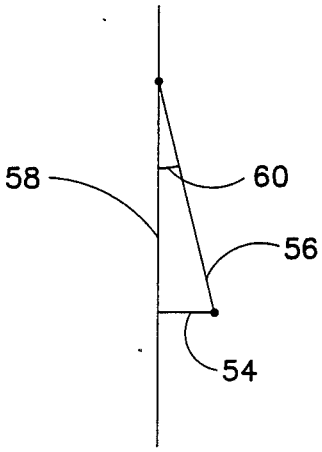
FIG. 9 is a geometrical illustration of the distances and angles encountered between the glass fiber, stripping body, and the pulling wheel.

Geometrically, it is clear that a change in angle of the glass fiber's trajectory will result. An illustration of this is given in FIG. 9. If, in FIG. 9, the distances 56 and 58 are constant or negligibly changed during rotation of the pulling wheel, and the distance 54 is changed greatly, then a change in the angle 60 will result. In the same way, the angle of the trajectory of the glass fiber 46 changes relative to the conveyer.

Figure 8:
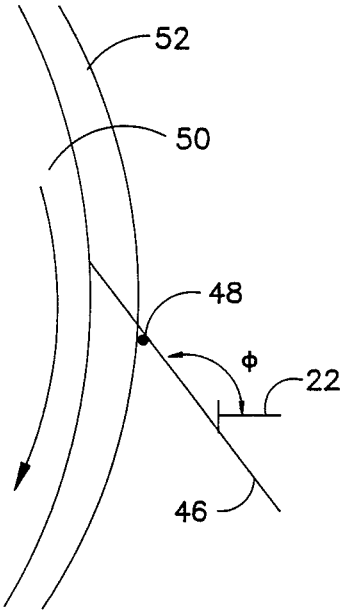

As the channel surface in the pulling wheel 50 in FIG. 8 continues to recede with the rotation of the pulling wheel 50, the angle of the glass fiber 46 relative to the conveyer 22 continues to increase. This increase continues until the peripheral surface of the channel on the pulling wheel 50 recedes the maximum amount relative to the stripping wire 48.

FIG. 8 illustrates this position and a resulting angle phi. This angle phi is the maximum angle the glass fiber 46 achieves relative to the conveyer 22. After the channel surface on the pulling wheel 50 has reached its maximum distance from the stripping wire 48, the channel surface then begins to extend outward toward the stripping wire 48. The angle between the glass fiber 46 and the conveyer 22 gradually decreases back to theta when the distance between the stripping wire 48 and the channel surface formed in the pulling wheel 50 is at its minimum.

The path which the glass fiber 53 follows as it leaves the stripping wire on its way toward the conveyer 22, oscillates as the pulling wheel 20 rotates. This path is generally sinusoidal in shape, shown as section 55 in FIG. 10. Further toward the conveyer the fiber has a sine wave configuration with a progressively shorter wavelength as shown in section 57 and the sine waves continue to stack upon each other as seen more in section 59 as they encounter the friction of air and continue further toward the conveyer 22. The control over the path of the glass fiber 53 is a key object of the present invention.

The glass fiber which is projected from the stripping wire 26 downward toward the conveyer 22 is actually a column of glass. By oscillating this column and taking into consideration the diameter of the fiber and the force of air friction upon it, it is possible to control the locations of subsequently occurring bends of the glass column by varying the frequency and amplitude of the oscillations, the circumferential distance between lobes and the feed rate of the fiber. Trial and error techniques can be used to get the desired fiber size and configuration for the desired mat characteristics. These bends are due to the back and forth motion of the glass fiber caused by the oscillation of the glass fiber's trajectory.

Figure 10:
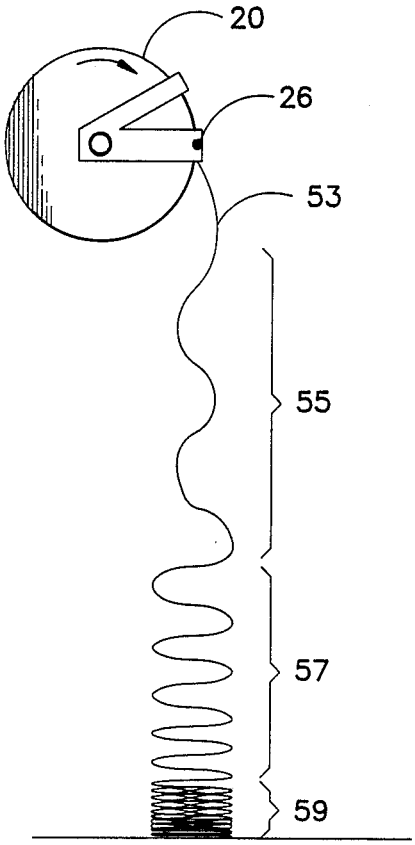
FIG. 10 is view in perspective showing a general pattern which glass fibers follow when being projected from a pulling wheel.

The fiber 53, in FIG. 10, is therefore made to follow a sine wave configuration as it is projected downward toward the conveyer 22. This sine wave begins to form as the glass fiber 53 leaves the stripping body 26 and becomes more and more pronounced as it approaches the conveyer 22. As the sinusoidally shaped fiber approaches the conveyer, it begins to stack upon previous sine waves in mid air. At this distance, the force imposed upon the glass fiber 53 by the projection from the pulling wheel 20 has diminished and the stacked up fibers fall to the conveyer solely by the force of gravity.

By the time the fiber begins this free fall, it has attained a figure eight or looped orientation. As the sine waves initially left the stripping means, the fiber was contained principally in the vertical plane, whereas the free falling figure eights or elliptical loops subsequently formed become oriented in the horizontal plane, parallel to the conveyer 22. This figure eight or loop patterned fiber falls to the conveyer 22 and forms a path of figure eights or elliptical loops.

The glass fiber mat formed is built up of these paths of continuous fibers, having a layered series of figure eights or loops, one on top of another. The layering occurs because of the back and forth impingement of the glass fiber on the conveyer 22 caused by the primary oscillation of the stripping body 26 on the surface of the pulling wheel 20.

A further, more controllable layering effect may occur by having a series of glass fiber mat manufacturing machines under which the conveyer 22 passes such that each machine places another layer of glass fiber mat upon the previous machine's layer. This method would allow a sandwiching of various density and other property layers of glass fiber mat.

The loop shape, that is the dimensions of the rounded portions of the figure eights or elliptical loops in the glass fiber mat, determine the direction of strength of the glass fiber mat in the consumer's finished products. Certain processes require certain strengths of the mat in specific directions. As stated above, ladder rails require a mat which provides a greater strength laterally, whereas automobile fenders should be omni-directional in strength. The control over the direction of strength is therefore crucial and is an object of the present invention.

The dimensions of the loops are determined by the diameter of the glass fibers, the speed of the rotating pulling wheel 20, the number of lobes on the pulling wheel 20, the primary oscillation rate, and the depth of the channels on the peripheral surface of the pulling wheel 20. All of these factors can be controlled and, thus, so can the dimensions of the figure eights or elliptical loops.

The Loop Formation Ratio is a ratio of the length of glass fiber projected from the pulling wheel 20, to the lateral distance of mat on the conveyer 22 over which it is deposited. The Loop Formation Ratio in the present invention is typically between seven and fifteen but can be between four and twenty, up from between one and two in previous inventions. This can be interpreted as meaning the present invention has increased length of glass fiber which is formed in each foot of lateral width of the mat and additionally, has brought control of this Loop Formation Ratio.

The result of raising the Loop formation Ratio is a mat which has more length of glass fiber in its particular width in addition to having greater bulk or loft thereby giving a greater ability to retain resin. This greater height is a result of increasing the number of cross-over points of glass fibers on other glass fibers. By increasing the total length of glass fibers, and therefore the surface area, in the mat and increasing the height of the mat, the amount of synthetic resin which is held by or passed through the mat has been increased dramatically and, more importantly, is controllable.

The Loop Formation Ratio is entirely controllable by the present invention and, as such, the direction of the strength of the product formed from the mat is completely controllable. Additionally, the amount of resin which can be held by the glass fiber mat is controllable.

The Loop Formation Ratio in the present invention is controlled by the frequencies and the amplitudes of the primary oscillation of the release mechanism.

Figure 11:
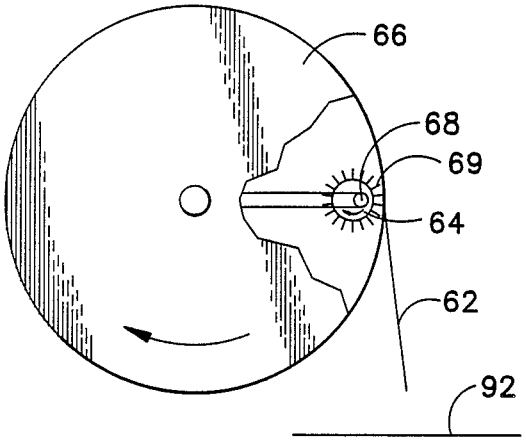
FIG. 11 is a cutaway view in perspective of an alternative embodiment of the present invention.
Figure 12:
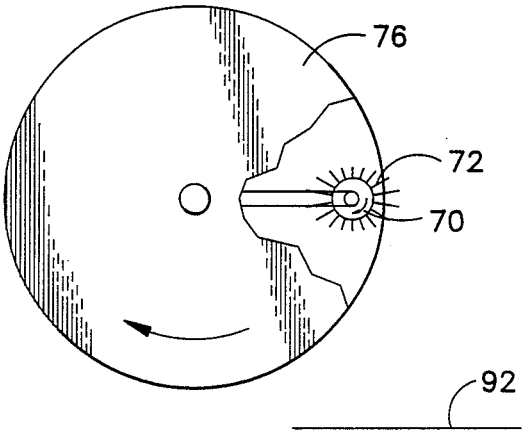
FIG. 12 is a cutaway view in perspective of an alternative embodiment of the present invention.

An alternative embodiment of the present invention for creating an oscillation of the angle of the trajectory of the glass fiber 62 relative to the conveyer 22 is a finger wheel 64, shown in FIG. 11. A finger wheel 64 is a conventional device which comprises a wheel which is internal of the pulling wheel 66 and has fingers 69 which protrude out of a portion of the pulling wheel 66. As the glass fiber 62 passes over the pulling wheel 66 the protruding fingers 69 release the glass fiber 62 from the pulling wheel 66 projecting it down and onto a conveyer 92. A possible means for creating the oscillation necessary would be to have a finger wheel 64 rotated about a point 68 which is offset from the finger wheel's center of rotation. The cam effect produced by this mechanism would force the tips of the fingers 69 to protrude and oscillate their distance from the pulling wheel's 66 outer peripheral surface. This oscillation would be similar to the secondary oscillation of the angle of the trajectory of the glass fibers 62 relative to the conveyer which is the preferred embodiment of the present invention.

Another possible embodiment for using the conventionally known finger wheel to create the secondary oscillation is to use a finger wheel 70 which has fingers 72 that have various graduating lengths around the circumference of the finger wheel 70, such that a lobe effect is created around the finger wheel 70. This would provide a protruding set of fingers 72 which would oscillate in their distance between the pulling wheel 76 surface and oscillate the trajectory as in the previously stated finger wheel 64.

Of course the secondary oscillations can be created with the finger wheel type stripping mechanism by retaining the conventional finger mechanism and forming lobes on its wheel of the type described in connection with the preferred embodiment.

Figure 13:
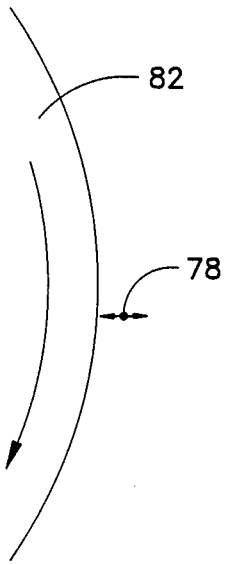
FIG. 13 is a view in perspective of an alternative embodiment of the present invention.
Figure 14:
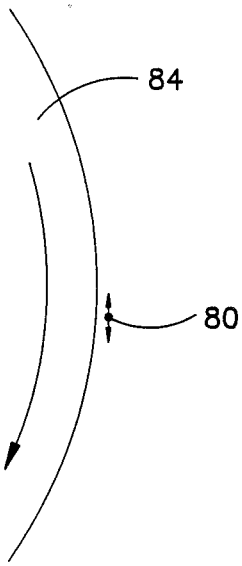
FIG. 14 is a view in perspective of an alternative embodiment of the present invention.

Another alternative embodiment of the present invention shown in FIGS. 13 and 14, comprises a stripping wire 78 and 80, wherein the stripping wire 78 or 80 could be caused to oscillate with a radial or a circumferential component relative to the pulling wheel 82 or 84 surface. This oscillation would cause the angle of the trajectory of the glass fiber to oscillate relative to the conveyer as in the preferred embodiment.

Figure 15:
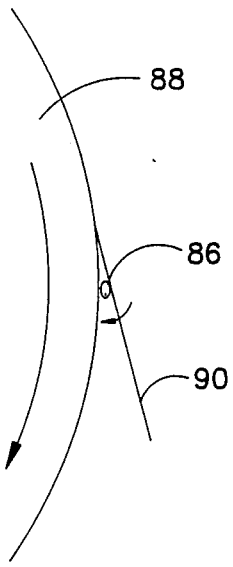
FIG. 15 is a view in perspective of an alternative embodiment of the present invention.

Another alternative embodiment comprises an elliptical stripping wire 86, shown in FIG. 15, rotated about its axis, parallel to the axis of the pulling wheel 88. This would cause the distance between the glass fiber 90 and the pulling wheel 88 surface to oscillate, thereby oscillating the angle of trajectory of the glass fiber 90 as in the preferred embodiment.

Figure 16:
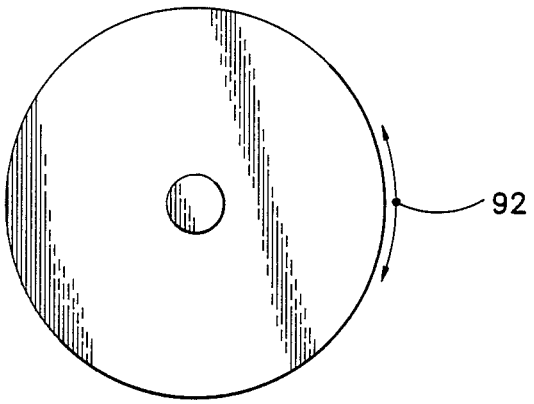
FIG. 16 is a view in perspective of an alternative embodiment of the present invention.

A still further embodiment shown in FIG. 16, comprises a secondary, mechanical, arcuate, oscillation of a stripping wire 92. This secondary oscillation superimposed upon the primary arcuate oscillation of the stripping wire 92 would provide a similar secondary oscillation of the angle of the trajectory as in the preferred embodiment.

Figure 17:
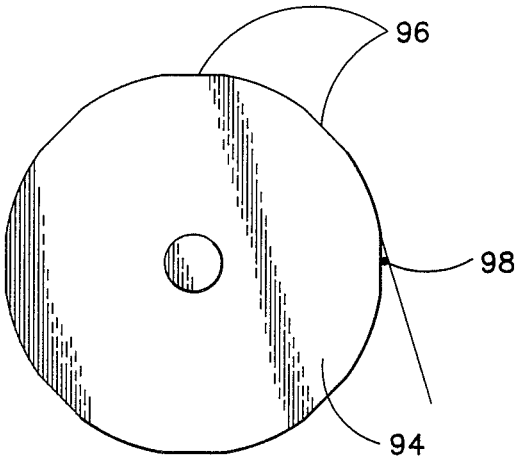
FIG. 17 is a view in perspective of an alternative embodiment of the present invention.

While the secondary oscillation is preferably sinusoidal, a periodic, other than sinusoidal oscillation, is possible. A graphical representation of the oscillation could even be square or triangle wave shaped. For example, if a pulling wheel 94, as illustrated in FIG. 17, were to have flat spots 96 machined into channels in its outer peripheral surface, the required oscillation of the distance between the stripping wire 98 and the pulling wheel 94 surface would be achieved. However, this would provide certain disadvantages, such as loss of control, which the preferred embodiment and several other embodiments of the present invention have overcome.

The present invention is particularly useful for projecting continuous glass fiber on preforms. In the past, preforms have been used for forming a fiberglass reinforcement mat in the shape of a part to be molded. The preform is simply a foraminous or a perforate mold wall to which a vacuum is applied to its porous surface. In the past chopped glass fibers, for example of two inch length, have been blown onto a preform and held by the air current drawn by the vacuum. A binder is then applied by being blown onto the mat and the mat with its binder is then heated to bond the glass fiber into the preform shape. The preformed mat is then inserted in a molding press and resin is injected so that the mat is infiltrated with the resin to form the molded fiberglass reinforced resin part.

With the present invention desirably a vacuum is still drawn on the preform to hold the glass fiber in place. However, a continuous glass fiber is projected onto the preform using the methods of the present invention. Thus, with the present invention the fiber may be projected not only onto a relatively planar conveyor surface, but also onto a shaped and contoured surface. By using the present invention the strength of the parts are substantially enhanced because the fiber is continuous, rather than chopped segments of fiber. Additionally, because the present invention permits the control of the size and configuration of the loops or figure eights into which the glass fiber falls against the surface onto which it is projected, the present invention also permits control of the strength and directionality of the strength characteristics of the fiberglass reinforcing mat and therefore of the finished part.

Thus, it becomes apparent that the forming surface onto which the fiber is projected in accordance with the present invention may be a relatively planar conveyer or a contoured forming surface.

While certain preferred embodiments of the present invention have been disclosed in detail, it is to be understood that various modifications may be adopted without departing from the spirit of the invention or scope of the following claims.

We claim:

1. In a glass fiber mat manufacturing method comprising passing at least one glass fiber over at least one cylindrical drum and subsequently releasing and projecting the fiber onto a forming surface by a release mechanism operating at a primary oscillation across the forming surface of the angle of the trajectory of the glass fiber relative to the forming surface, an improved mat pattern control method comprising superimposing a secondary oscillation of the angle of the trajectory of the glass fiber relative to the forming surface upon the primary oscillation at a higher frequency and lower amplitude than the primary oscillation.

2. The method according to claim 1 wherein superimposing the secondary oscillation is accomplished by oscillating a component of the angle of the trajectory radially of the cylindrical drum.

3. The method according to claim 2 wherein oscillating the radial component is accomplished by oscillating the position of the peripheral surface of the drum relative to the release mechanism.

4. The method according to claim 3 wherein oscillating the drum surface is accomplished by rotating a drum having a varying peripheral radius.

5. The method according to claim 2 wherein oscillating the radial component is accomplished by oscillating the release mechanism relative to the drum surface.

6. The method according to claim 5 wherein oscillating the release mechanism is accomplished by rotating an internal, partially emerging, cam acting finger wheel.

7. The method according to claim 5 wherein oscillating the release mechanism is accomplished by vibrating a thin stripping wire.

8. The method according to claim I wherein superimposing the secondary oscillation is accomplished by oscillating a circumferential component of the position of the release mechanism with respect to the drum.

9. The method according to claim 8 wherein oscillating a circumferential component of the position of the release mechanism is accomplished by superimposing a secondary, higher frequency, lower amplitude, arcuate oscillation of the release mechanism upon the primary oscillation.

10. The method according to claim 8 wherein oscillating the circumferential component of the position of the release mechanism is accomplished by vibrating the release mechanism parallel to a tangent of the drum.

11. In a glass fiber mat manufacturing machine comprising at least one glass fiber passed over at least one cylindrical drum from which it is subsequently released and projected onto a forming surface by a release mechanism operating at a primary oscillation across the forming surface of the angle of the trajectory of the glass fiber relative to the forming surface, an improved mat pattern control comprising means for superimposing a secondary oscillation of the angle of the trajectory of the glass fiber relative to the forming surface superimposed upon the primary oscillation at a higher frequency and lower amplitude than the primary oscillation.

12. The means according to claim wherein the superimposing means comprises a means for oscillating a component of the angle of the trajectory radially of the cylindrical drum.

13. The means according to claim 12 wherein the means for oscillating a component of the angle of the trajectory comprises a means for oscillating the position of the peripheral surface of the drum relative to the release mechanism.

14. The means according to claim 13 wherein the means for oscillating the drum surface comprises at least one lobe formed on the peripheral surface of the cylindrical drum, such that as the drum is rotated the position of the peripheral surface of the drum oscillates relative to the release mechanism.

15. The means according to claim 14 wherein the means for oscillating the drum surface comprises exactly two lobes.

16. The means according to claim 14 or 15 wherein the lobe comprises at least one circumferential channel, formed in the peripheral surface of the cylindrical drum, whose depth oscillates upon rotation of the cylindrical drum due to a variation in its center of curvature relative to the center of rotation of the cylindrical drum.

17. The means according to claim 16 wherein the channel comprises a plurality of circumferential groove surfaces and groove joining surfaces on which the glass fibers may lie and which facilitate quick changing of the path of the glass fibers lying on the groove surfaces and groove joining surfaces by a coaxial displacement of the cylindrical drum.

18. The means according to claim 12 wherein the means for oscillating the radial component of the angle of the trajectory comprises means for oscillating the motion of the release mechanism relative to the peripheral surface of the drum.

19. The means according to claim 18 wherein the release mechanism comprises a thin wire, parallel to the axis of the drum, resting on the surface of the drum and vibrating radially of the cylindrical drum.

20. The means according to claim 18 wherein the release mechanism comprises a rotatably driven elliptical wire, parallel to the axis of the drum and resting on the surface of the drum.

21. The means according to claim 18 wherein the release mechanism comprises finger-like projections extending outwardly from a portion of the drum surface, extending from a rotatably driven, internal wheel.

22. The means according to claim 21 wherein the finger-like projections are formed extending radially outward on a wheel internal of the drum and are of varying lengths such that as the internal wheel rotates, the distance from the drum surface to the tips of the finger-like projections oscillates.

23. The means according to claim 21 wherein the finger-like projections are of equal lengths and mounted extending radially outward on a wheel internal of the drum whose axis of rotation is offset from the center of curvature of the wheel such that as the internal wheel is rotated, a cam action is produced causing the distance between the drum surface and the tips of the finger-like projections to oscillate.

24. The means according to claim 11 wherein the superimposing means comprise a means for oscillating a circumferential component of the position of the release mechanism with respect to the cylindrical drum.

25. The means according to claim 24 wherein the means for oscillating the circumferential component comprises a means for superimposing a secondary higher frequency, lower amplitude, arcuate oscillation of the release mechanism up on the primary oscillation of the release mechanism.

26. The means according to claim 24 wherein the means for oscillating the circumferential component means for vibrating the releasing mechanism parallel to a tangent of the surface of the cylindrical drum.

* * * * *